US007900554B2

(12) United States Patent
Görlitz

(10) Patent No.: US 7,900,554 B2
(45) Date of Patent: Mar. 8, 2011

(54) METHOD FOR CONTROLLING THE ROLL WEIGHTING IN ROLL SHELLERS

(75) Inventor: Frank-Otto Görlitz, Braunschweig (DE)

(73) Assignee: Buhler AG, Uzwil (CH)

( * ) Notice: Subject to any disclaimer, the term of this patent is extended or adjusted under 35 U.S.C. 154(b) by 649 days.

(21) Appl. No.: 11/660,322

(22) PCT Filed: Dec. 20, 2004

(86) PCT No.: PCT/CH2004/000748

§ 371 (c)(1),
(2), (4) Date: Feb. 15, 2007

(87) PCT Pub. No.: WO2006/017947

PCT Pub. Date: Feb. 23, 2006

(65) Prior Publication Data

US 2007/0245906 A1 Oct. 25, 2007

(30) Foreign Application Priority Data

Aug. 18, 2004 (DE) ..... 10 2004 040 133

(51) Int. Cl.
*B02B 3/04* (2006.01)

(52) U.S. Cl. ..... 99/617; 99/623

(58) Field of Classification Search ..... 99/617, 99/623, 624, 625

See application file for complete search history.

(56) References Cited

U.S. PATENT DOCUMENTS

| | | | | |
|---|---|---|---|---|
| 4,377,110 | A | 3/1983 | Matsumoto | |
| 5,678,477 | A * | 10/1997 | Satake et al. | 99/519 |
| 2002/0011155 | A1 * | 1/2002 | Houri et al. | 99/519 |

FOREIGN PATENT DOCUMENTS

| | | | |
|---|---|---|---|
| GB | 797372 | | 7/1958 |
| GB | 952668 | | 3/1964 |
| JP | 6-226118 | A | 8/1994 |
| JP | 8-141418 | A | 6/1996 |
| JP | 8-323226 | A | 12/1996 |
| JP | 9-155210 | A | 6/1997 |

* cited by examiner

*Primary Examiner* — Mark H Paschall
(74) *Attorney, Agent, or Firm* — Buchanan Ingersoll & Rooney PC

(57) ABSTRACT

A method for controlling the roll weighting in roll shellers, in particular in rubber roll shellers for shelling rice or other cereal grains, includes recipe values for the grains to be shelled making it possible to independently regulate motor current, feed quantity and pressure values for roll weighting.

12 Claims, 1 Drawing Sheet

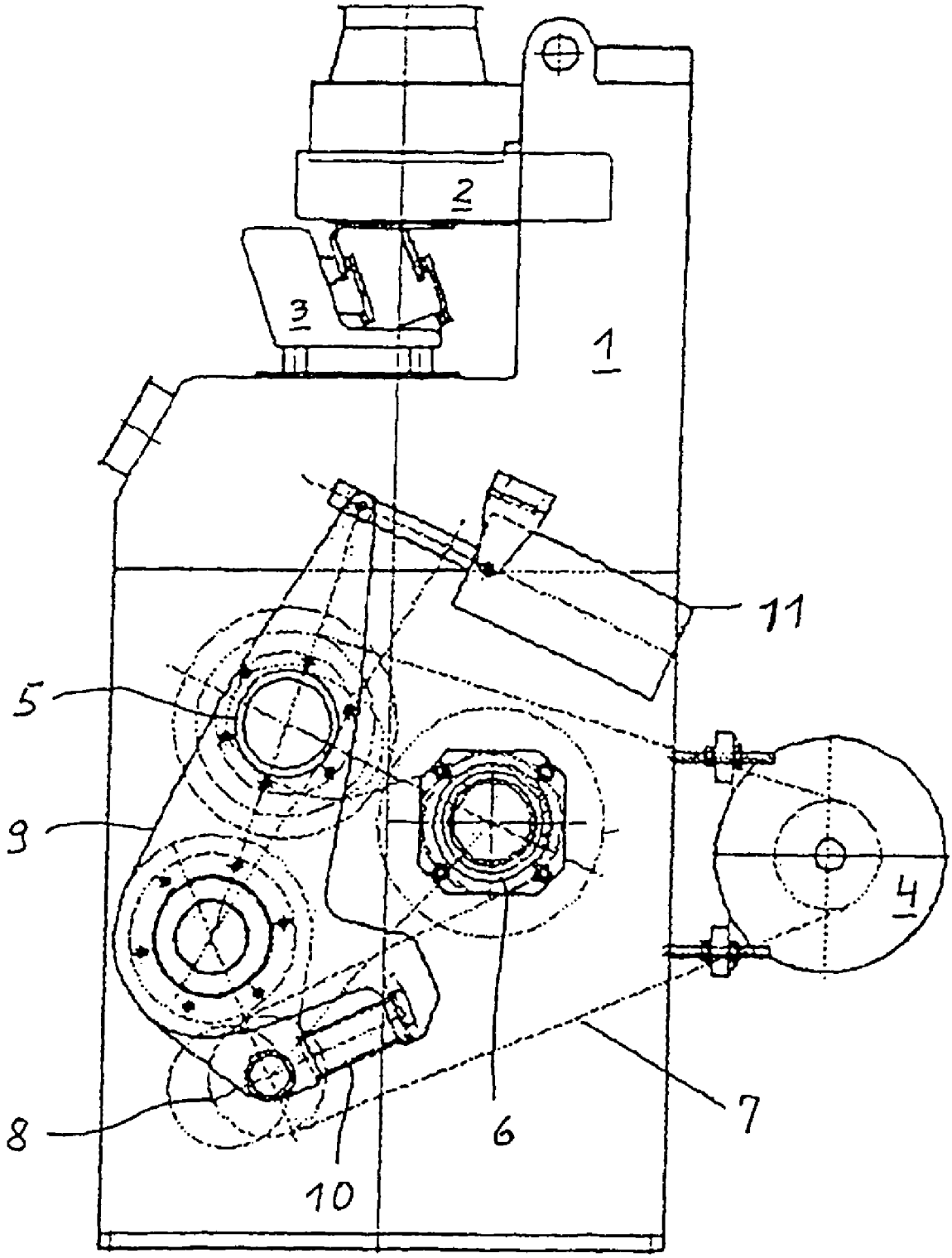
2
3
1
11
5
9
4
8
6
7
10

METHOD FOR CONTROLLING THE ROLL WEIGHTING IN ROLL SHELLERS

The invention relates to a method for controlling the roll weighting in roll shellers, in particular in rubber roll shellers for shelling rice or other cereal grains.

The roll contact pressure in roll shellers is most often controlled by means of pressure regulators of pneumatic cylinders for roll weighting, wherein the manipulated variable is handled manually, as is the control of the feed quantity of the grains to be shelled, in particular paddy. The operator must here take various dependencies relative to roll contact pressure and feed quantity into account, e.g., between the roll contact pressure, shelling degree, feed quantity and power consumption of the motor, wherein a maximum motor current may not be exceeded. In addition, PN cylinders exhibit significant friction, the influence of which distorts the roll weighting, i.e., friction causes the contact pressure to not precisely correspond to the set pressure values.

The object of the invention is now to develop a method for controlling the roll weighting in roll shellers that enables a more precise and largely automated control of roll weighting.

The roll contact pressure is crucial to shelling action in rubber roll shellers. Therefore, it must be possible to precisely set the shelling pressure. The roll contact pressure is controlled as a function of a pre-selected power consumption of the sheller motor in order to help give the rolls, in particular rubber rolls, an optimum shelling pressure from the very start. This can be done by prescribing a set pressure, so that manual operation can be limited to specified values, e.g., to recipes for different sorts of rice. This makes it possible to automatically regulate pressure by way of the power consumption of the drive motor for the rolls. Actuation can take place via an SPS/PPS, and the previously usual contactors are omitted. Even at a preset current level, the roll weighting can still be changed. The roll pressure cannot be increased any further once the maximum current level has been reached.

While the rolls can be weighted by means of pneumatic pressure cylinders, a further development makes it possible to do without pressure cylinders, and adjust the rolls with a servomotor, whose stroke is regulated via the power consumption of the drive motor.

It is also possible to stipulate the current depending on wear, i.e., introduce a preset, or adjustable curve, which changes the set value for motor current as a function of roll wear. A servomotor can be used to automatically reset/adjust the set value of the motor current as a function of the servomotor position. A position pickup is necessary for a pressure cylinder.

Further, it is possible to install a force sensor between the PN cylinder or servomotor and loose roll, which ascertains the exact pressure force between the actuator and mount of the moving roll, and hence precludes any exposure to friction of the PN cylinder.

Another object of the invention is to provide a suitable roll sheller for this purpose.

The invention will be described below in an exemplary embodiment based on a drawing in partial cross section.

With the pre-selection of a recipe (rice sort), recipe settings are input to an SPS for pre-selecting a starting pressure of a roll contact pressure pneumatic system of a rubber roll sheller, e.g., the set motor current or minimum and maximum pressure values of the pneumatic system. If necessary, error messages can be shown on the display.

When using a pressure sensor, the desired pressure force can be pre-selected.

Once the working position has been selected, the rolls engage via a solenoid valve and pressure regulator with the starting pressure or force prescribed in the recipe, and the sheller starts up as the feeding process begins. During operation, suitable open and closed-loop control functions apply, such as:

- Current level of motor in prescribed value range
- Force level when using a force sensor
- If necessary, increase roll contact pressure by dropping the PN pressure (or reversal)
- Detection of roll wear from progression of power consumption and automatic adjustment of current, if necessary with display of roll wear Hence, the pressure and/or feed quantities are independently regulated as a function of the motor current or force measurement. For example, the current can be held constant relative to the shelling degree for a rice sort and throughput. The roll sheller drive can here be coupled to the feeder, e.g., by means of a vibrating groove, and to the set current.

Parameters such as set current, PN pressure, contact pressure and feeding can be varied during operation.

Small changes in roll weighting caused by changes in belt tension over the wearing area of the rolls can also be compensated.

Adjustments are introduced via the power consumption or force value at the force sensor, and no longer via the PN pressure, especially since the latter does not precisely represent the shelling pressure.

By contrast, there are additional advantages to weighting the rolls with a servomotor 11, e.g., stick-slip effects or oscillations are avoided, since a servomotor 11 is rigid in its power transmission. Depending on the actuator travel, the contact pressure of the shelling rolls 5, 6 is always constant.

Regulation by means of the roll motor current makes it possible to correct the loose roll 5 of the shelling rolls 5, 6 to adjust roll wear, so that the roll wear can be ascertained and, for example, the time for a roll change can be determined via an achieved maximum roll contact pressure value, and no longer based on the measured actuator travel of the loose roll 5.

The roll sheller 1 can then also be operated completely with only one form of energy, including vibrating feeder 2/vibrating groove 3. Expensive pressure regulators and solenoid valves for pneumatic arrangements are no longer necessary.

However, the servomotor 11 can also be used to simplify the design of the rocker, if the drive motor 4 is simultaneously secured rigidly to the casing of the roll sheller 1. Only a spring excursion of approx. 10-20 mm need be provided in the return strand for the tensioning roll 8, and the tensioning roll 8 is to be spring-supported against the mount lever (rocker 9) of the loose roll 5.

The spring support (spring 10) of the tensioning roll 8 acts independently of the adjustment by a servomotor 11, a PN cylinder, or the like.

Because the tensioning roll 8 is rotated with the rocker 9 for the loose roll 5, at least a large part of length compensation relative to the twin toothed belt or twin V-belt set 7 with a fixed motor takes place by way of a movement of the rocker 9 with the coupled tensioning roll 8. The spring need only enhance the differential amount of required length compensation. The spring 10 for the tensioning roll 8 is supported against the rocker 9, and the pivot of the tensioning roll 8 is preferably located in the pivot of the rocker 9 or in proximity thereto on the rocker 9 or on the casing of the roll sheller 1.

The invention claimed is:

1. A method for regulating a roll contact pressure in a roll husker, wherein two rolls are driven by a motor, and the rolls are pressed against each other by a weight moment of a rocker arm and contact pressure means in an operational mode, and rice or other grains are husked in a roll nip, the method comprising:

pre-selecting a desired motor current; operating a controller for regulating the motor current, a feed quantity and a pressure force for the contact pressure means independently for a desired shelling degree, and wherein the roll contact pressure or a position of a servomotor is regulated as a function of the pre-selected motor current.

2. The method according to claim 1, wherein a PN pressure or servomotor position is regulated via a force sensor as a function of a preselected force.

3. The method according to claim 1, wherein the pressure value can be manually altered during operation, and wherein an altered current value is stored as a new setpoint during this time, and a new current value serves as the setpoint for regulation purposes after alteration of the pressure value.

4. The method according to claim 1, wherein the roll contact pressure is generated by the servomotor or a pressure cylinder.

5. The method according to claim 1, wherein the contact pressure can be automatically altered as a function of the roll wear according to a prescribed curve by measuring the path on the loose roll via the servomotor position or displacement sensors.

6. The method according to claim 1, wherein a tensioning roll is supported against a bearing lever of a loose roll by a spring.

7. The method according to claim 1, wherein a feed capacity and a setpoint current of the drive motor are coupled.

8. The method according to claim 1, wherein an achieved maximum roll contact pressure value is used as a signal for a required roll replacement.

9. A roll husker for shelling cereal grains comprising:

a feeder for the grains to be husked;

a pair of husking rolls driven by a motor;

means for pressing the husking rolls;

an input for pre-selection of a desired motor current;

a controller for regulating the motor current, a feed quantity and a pressure force for a roll contact pressure means independently for a desired shelling degree and wherein the roll contact pressure or a servomotor position are regulated as a function of the pre-selected motor current.

10. The roll husker according to claim 9, wherein a tensioning roll is supported against a bearing lever of a loose roll of the husking rolls by a spring.

11. The roll husker according to claim 9, wherein a tensioning roll is mounted in a pivot of a bearing lever to a loose roll.

12. The roll husker according to claim 9, wherein the roll husker is a rubber roll husker.

* * * * *